US006259193B1

(12) United States Patent
Lipkin et al.

(10) Patent No.: US 6,259,193 B1
(45) Date of Patent: Jul. 10, 2001

(54) EMISSIVE FILAMENT AND SUPPORT STRUCTURE

(75) Inventors: Don Mark Lipkin, Niskayuna; Carl Edward Erikson, Schenectady; Bernard Patrick Bewlay, Schenectady; Dennis Joseph Dalpe, Schenectady, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/093,046

(22) Filed: Jun. 8, 1998

(51) Int. Cl.[7] ..... H01J 1/15; H01J 19/08; H01J 1/02

(52) U.S. Cl. ..... 313/341; 313/271

(58) Field of Search ..... 313/323, 341, 313/342, 343, 344, 345, 346 R, 348, 349, 351, 358, 238, 243, 271, 272, 273, 279, 281, 292, 315, 316

(56) References Cited

U.S. PATENT DOCUMENTS

| | | | | |
|---|---|---|---|---|
| 2,919,373 | * | 12/1959 | Filey et al. | 313/340 |
| 3,307,974 | * | 3/1967 | Davis | 114/212 |
| 3,777,209 | * | 12/1973 | McDonnie et al. | 313/238 |
| 3,788,721 | * | 1/1974 | Vause | 316/17 |
| 3,914,639 | * | 10/1975 | Barraco et al. | 313/271 |
| 4,144,473 | * | 3/1979 | Almer | 313/315 |
| 4,205,254 | | 5/1980 | Kanai . | |
| 4,344,011 | | 8/1982 | Hayashi et al. . | |
| 4,777,642 | | 10/1988 | Ono . | |
| 4,868,842 | | 9/1989 | Dowd . | |
| 4,894,853 | | 1/1990 | Dowd . | |
| 5,077,777 | | 12/1991 | Daly . | |
| 6,115,453 | | 9/2000 | Hell et al. | 378/186 |

FOREIGN PATENT DOCUMENTS

| | | |
|---|---|---|
| 0235619 | 2/1987 | (EP) . |
| 1526262 | 5/1968 | (FR) . |
| 2395595 | 6/1978 | (FR) . |
| 1011398 | 1/1964 | (GB) . |

* cited by examiner

*Primary Examiner*—Ashok Patel
*Assistant Examiner*—Matthew J. Gerike
(74) *Attorney, Agent, or Firm*—Robert P. Santandrea; Noreen C. Johnson

(57) ABSTRACT

A filament comprises a generally thin metal component, such as a sheet, ribbon, or foil. The filament comprises at least one emitter, at least one current-condensing structure and a tab on each end of the at least one emitter. Each tab is connectable to a support system, comprising for example a lead and attachment post. When a current is passed through the filament, the current-condensing structure establishes current flow through the filament resulting in a desired temperature distribution across the emitter, for example a substantially uniform temperature distribution. A predictive tool for determining a geometry of a filament to provide a desired temperature distribution is set forth. The filament may be curved, and methods and systems for providing a curved filament are also provided. Attachment systems are further disclosed for attaching an emitter to a support structure.

12 Claims, 9 Drawing Sheets

EMISSIVE FILAMENT AND SUPPORT STRUCTURE

FIELD OF INVENTION

The invention is related to filaments. In particular, the invention is related to filament construction for electronic emitters.

BACKGROUND OF THE INVENTION

A filament comprises at least one emitter. An emitter is a component that releases energy, as in the form of electrons, upon the absorption of energy. In the filament, the emitter is one element and the filament can include additional features. Alternatively, the filament can comprise a plurality of emitters.

Conventional filament designs for lighting and electronic emission generally comprise a helical coil geometry. While a helical coil has proven adequate for many applications that require relatively isotropic illumination, a helical coil may be inefficient for electronic emission. This inefficiency is partly due to space-charge limitations on emission current, which result in low saturation, and hence a weak signal. Additionally, a large fraction of electron trajectories reaches an associated anode outside a desired target area, leading to an undesirable focal spot profile.

The prior art in filaments, emitters, filament manufacture and support assemblies focuses on tungsten helical coil emitters. Attachment of helical coil filaments to supports is accomplished by crimping the filament wire inside electrically conducting leads. The techniques used in this method of attachment often result in filament misalignment, leading to undesirable focal spot characteristics.

Ribbon-like filaments, and their emitters, have been known in the art for illumination and electronic emission purposes. These ribbon filaments generally comprise a single emitter. These known ribbon filaments comprise integrally formed leads, and are thus difficult to attach to supports with a desired alignment accuracy. The integral-lead configuration compromises the filament alignment in a cathode assembly because the ribbon filaments are prone to warp as the integral leads are twisted during attachment to the support structure.

Near-isothermal heating is exhibited in sufficiently long helical coil filaments due to the coils possessing an extended length of uniform cross-section. The uniform cross-section results in essentially negligible heat conduction along a potion of the filament. Known ribbon filaments do not maintain a uniform temperature across the emitter and hence do not approach their potential thermionic emission current or life. Further, known ribbon filaments do not possess an engineered temperature distribution across the filament, and thus do not achieve their potential focal spot quality. Further deficiencies of known ribbon filaments include inadequate mounted stability and ease of alignment with a support and mounting structure, It is therefore desirable to improve performance of filaments and associated emitters by introducing filament designs that produce desired temperature distributions across emitters and prolonged emitter life, while attaining high emission currents and good focal spot quality. Also, it is desirable to provide filament geometries that offer substantial mounting advantages over conventional helical coils. The mounting advantages include, but are not limited to, enhanced focusability, geometric stability, consequent durability and ease of alignment within a filament mounting structure, and retention of focal spot quality.

SUMMARY OF THE INVENTION

One aspect of the invention provides a method for determining a geometry of a filament. The filament is composed of a thin metal foil, ribbon or sheet, and that has a geometry that exhibits a prescribed temperature distribution across it, thus enhancing electron emission and life. The method comprises generating a three-dimensional (hereinafter "3-D") mesh of a filament geometry; imposing boundary conditions on the 3-D mesh; solving a coupled thermal-electrical equation to determine a temperature distribution across a surface of the generated filament geometry subject to imposed boundary conditions; and determining that the filament geometry is acceptable when temperature distribution specifications are met. If the filament geometry does not conform to the temperature distribution specifications, the filament geometry determination method is iterated until the temperature distribution is acceptable.

A filament that is formed from a thin metal foil, ribbon or sheet is provided, as another embodiment of the invention. The filament comprises at least one emitter that releases energy, generally in the form of electrons or photons, at least one current-crowding structure that confines current flow, and at least one tab on each end of an emitter for attachment of the emitter. The emitter further comprises additional tabs. Thus, when current is passed through the filament, the current-crowding structure establishes current flow through the filament, resulting in a desired temperature distribution across the emitter.

Another aspect of the invention includes a method of making a curved filament. The method comprises providing a thin metal foil, ribbon or sheet starting filament, having at least one emitter and defining axes. The filament includes at least one current-crowding structure, so when current is passed through the filament the current-crowding structure establishes the desired temperature distribution across the filament. The method includes the steps of providing a first stationary die; disposing the filament on the first stationary die; providing a movable die; moving the moveable die toward the filament; and deforming the filament to produce a desired curvature in the filament.

Still another embodiment of the invention includes a support system for a filament support, where the filament comprises at least one emitter having tabs. The system includes a plurality of leads comprising tab connectors that allow attachment to the plurality of filament tabs; and further a support structure comprising at least a plurality of attachment posts, each post comprising a slot adapted to receive a lead. Thus, when each tab is attached to a lead and each lead is attached to a post, the filament is mechanically and electrically supported.

The filament, as set forth by the invention, is thin. For example, a filament possesses a thickness in the range between about 0.01 mm to about 1.0 mm. The filament comprises an appropriate emissive material such as, but not limited to a material selected from: substantially pure tungsten, tantalum, rhenium, and alloys thereof; a doped material, for example but not limited to potassium-doped tungsten for improved creep resistance; and at least one particulate containing material, such as carbides or oxide-containing materials for enhanced mechanical properties; and at least one of lanthanated, ceriated, hafniated, and thoriated tungsten for enhanced thernionic emission.

These and other aspects, advantages and salient features of the invention will become apparent from the following detailed description, which, when taken in conjunction with the annexed drawings, where like parts are designated by like reference characters throughout, discloses embodiments of the invention.

DETAILED DESCRIPTION OF THE INVENTION

Figure 1:
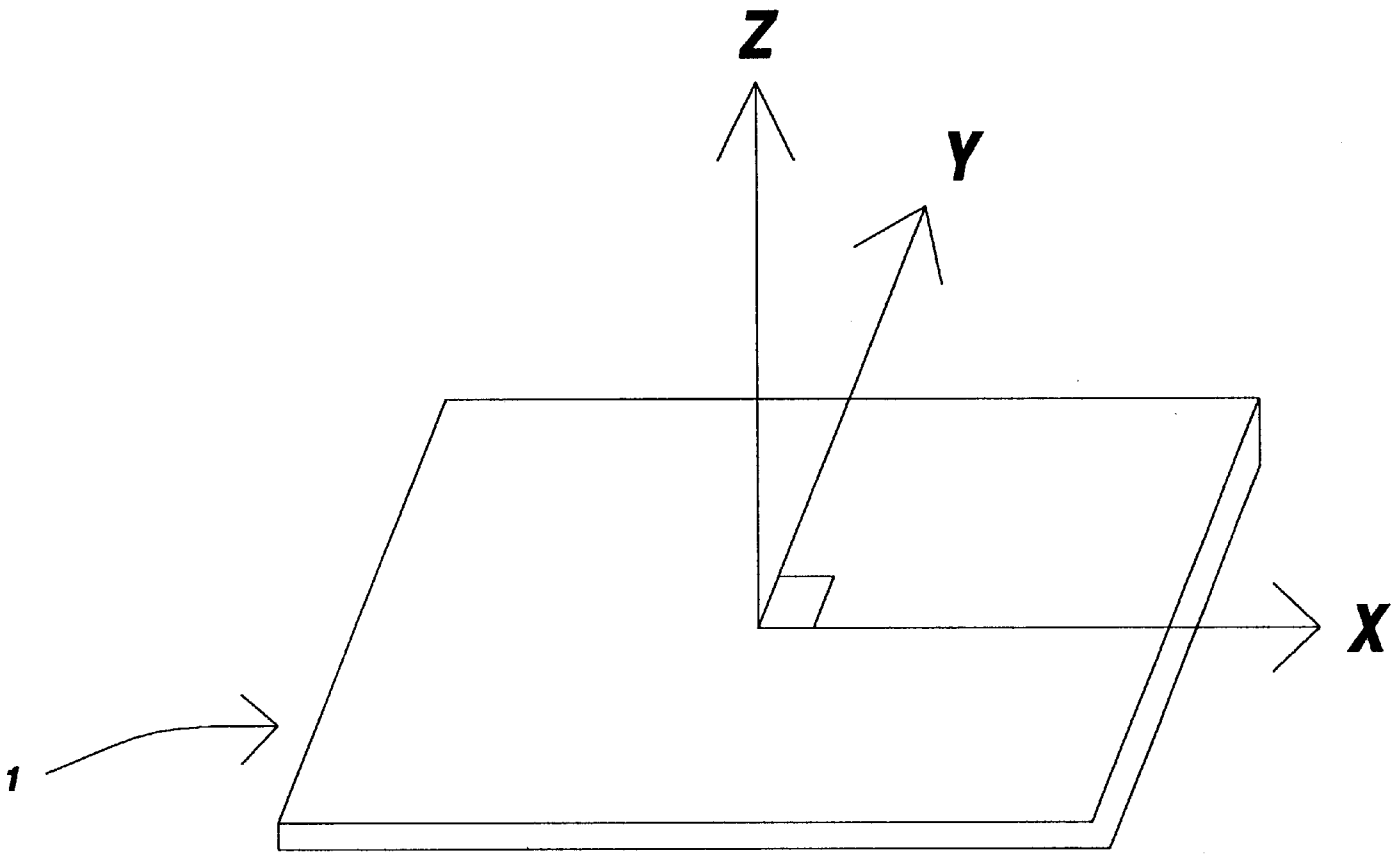
FIG. 1 is an explanatory view of a coordinate system on a generalized filament.

In this invention, a filament is a thin metal foil, ribbon or sheet, and comprises at least one emitter. As discussed above, the filament is thin, for example having a thickness in the range between about 0.01 mm to about 1.0 mm, and an emitter releases energy, such as electrons or photons, upon absorption of energy, such as energy from Joule heating. When a filament comprises one emitter, it is referred to as a single-emitter filament. If the filament comprises two or more emitters, it is referred to as a multi-emitter filament. FIG. 1 illustrates a filament 1 superimposed onto a set of three orthogonal coordinates x, y and z. In the following discussion, the xy plane defines the plane of the emitter, where the x axis defines a mean direction of current flow through the filament.

The filament comprises an appropriate emissive material such as, but not limited to a substantially pure material selected from the group consisting of: tungsten, tantalum, rhenium, and alloys thereof; a doped material, for example but not limited to potassium-doped tungsten for improved creep resistance. Alternatively, the material includes at least one of metal carbides and metal oxides for enhanced mechanical durability, and at least one of lanthanated, ceriated, hafniated, and thoriated tungsten for enhanced thermionic emission. A starting shape of the filament comprises a foil blank that has a thickness in a range between about 0.01 mm to about 1.0 mm with a surface area in a range from about 1.0 $mm^2$ to about 1000.0 $mm^2$. Accordingly, filaments can produce emission currents in the range between about 1.0 mA to bout 10.0 A. The exact filament dimensions vary in size depending on a desired emission current, life, and focal spot size.

Each filament comprises at least two end-connection portions, aftematively known as tabs, which are used to connect the filament to an appropriate electromechanical support structure. The number of tabs is usually one greater than the number of emitters. For example, if a filament comprises a single emitter, there are two tabs. If the filament comprises two emitters, there are three tabs, one of which is shared by each emitter. In general, for x emitters, the number of tabs is x+1.

The thermionic emission of an emitter is primarily dependent on temperature. Variations in temperature distribution across a filament can lead to drastic changes in thermionic emission. Filaments that provide a substantially planar, and alternatively a slightly curved emitting surface, offer substantial advantages over conventional helical coils. These advantages include increased emission current, improved focusing capability, extended emitter life, ease of alignment within a mounting structure, and long-term geometric stability, and subsequent retention of focal spot quality.

A predictive tool has been developed for determining a filament geometry that provides a desired temperature distribution across a filament, for example a substantially uniform temperature distribution. The model relies upon a 3-D numerical code to solve a coupled thermal-electrical problem of current passing through a patterned metallic conductor, and determines a filament design that enhances magnitude and distribution of the thermionic emission, while assuring the desired filament life.

The predictive tool uses a numerical solver, for example but not limited to, a finite-element code (FEM), to balance Joule heat in each filament with corresponding heat losses, for example those due to conduction and radiation. The filament design is then "tested" to check a temperature distribution across the filament. The methodology of the design tool is described below and in conjunction with FIG. 2.

Figure 2:
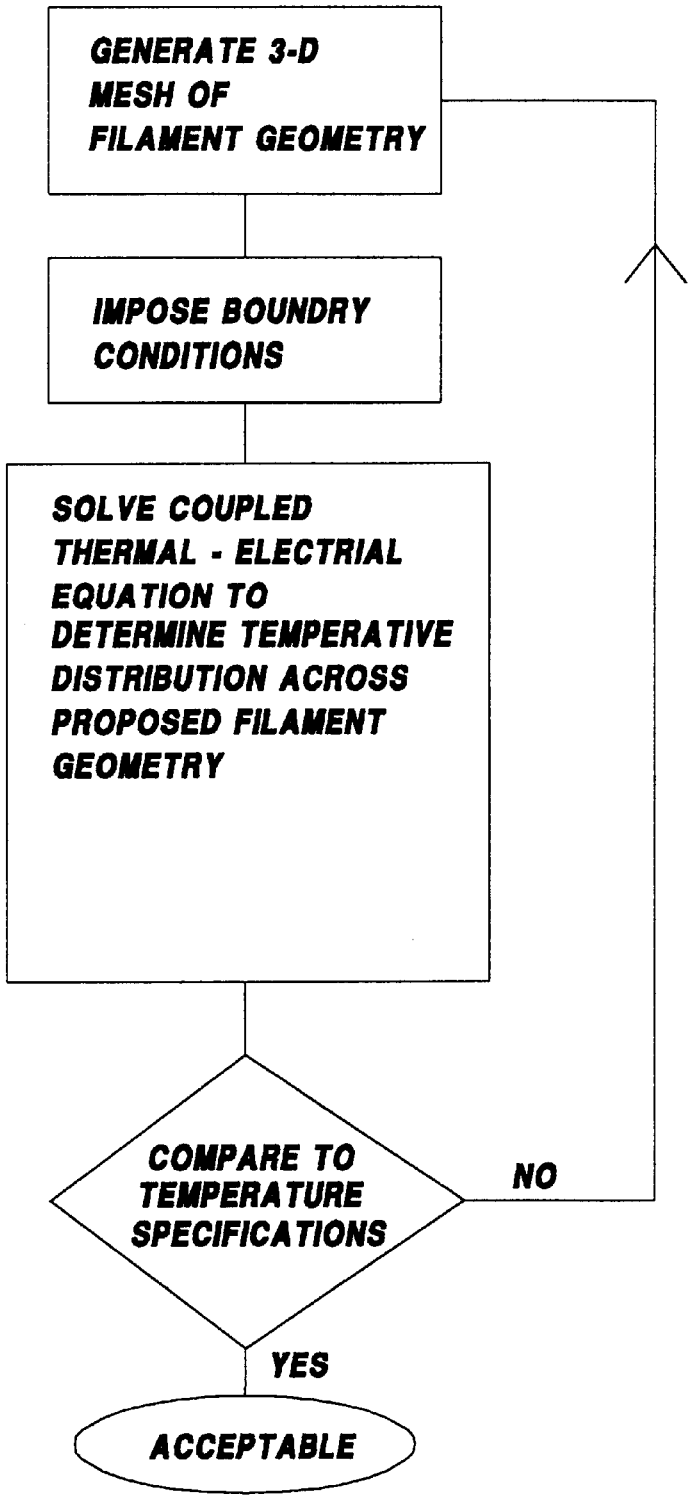
FIG. 2 is a flow chart illustrating a procedure to determine filament geometry.

In FIG. 2, the predictive model generates and meshes a 3-D filament design at step S1. In step S2, appropriate boundary conditions are imposed that comprise, but are not limited to, heating current, ambient temperature and lead temperature. In step S3, a coupled thermal-electrical equation is solved to determine a temperature distribution across the emitting surface. The coupled thermal-electrical equation accounts for Joule heating, emissive radiation, and thermal conduction.

In step S4, the temperature distribution calculated from step S3 is compared to temperature distribution specifications. If the temperature distribution specifications are met, the proposed filament design is determined to be acceptable in step S5. However, if the proposed filament design does not conform to temperature specifications, steps S1 through S4 are repeated with an appropriately modified geometry.

Steps S1 through S4 are iterated until temperature distribution specifications are met. At that point, the predictive tool and its method are complete.

The temperature distribution specifications chosen for the filament are determined according to its intended uses. For example, and in no way meant to limit the invention, temperature uniformity specifications are imposed, such that there is not greater than about ±25° K. variation across the emitter. Such specifications provide for increased emission current with respect to filament life.

Figure 3:
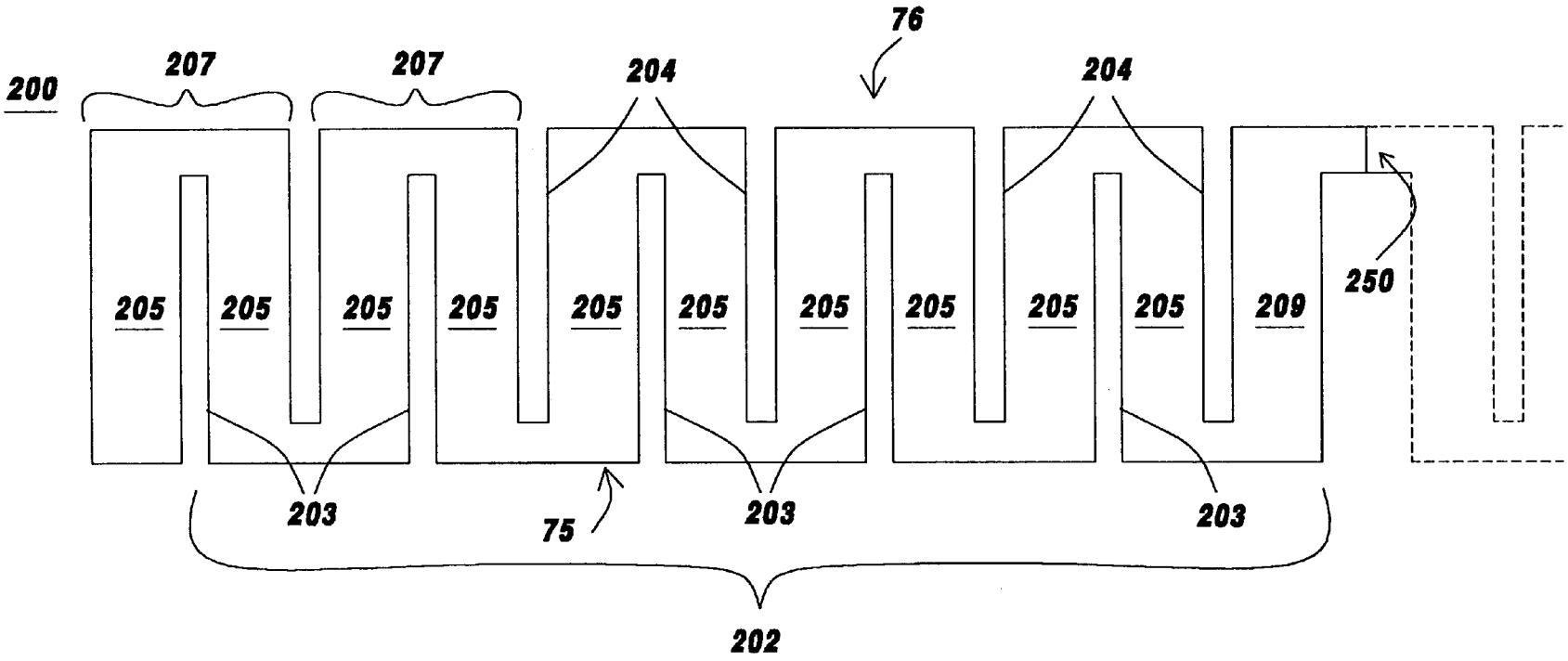
FIG. 3 is a schematic illustration of one-half of a dual-emitter filament.

One possible emitter configuration for a mufti-emitter filament 200 (here a dual-emitter filament) determined by the design tool is illustrated in FIG. 3. The filament 200 comprises an emitter 201 and its mirror image emitter, which is illustrated in phantom. In FIG. 3, exemplary dimensions of the emitter 201 comprise about a 2.0 mm×5.0 mm area, with a thickness of about 0.05 mm. Tabs 250 are maintained at a temperature of about 2000° K. The emitter operates with an applied current, i, equal to about 7 A. A resulting temperature distribution is essentially uniform over a portion of the emitter 201 (with about a ±25° K. variation), and a maximum temperature of about 2600° K. is reached. This description is merely exemplary and is not meant to limit the invention.

The filament 200, in FIG. 3, comprises an emitter 202 having a serpentine-pattemed configuration. The serpentine-patterned configuration is formed to control current flow through an active emitting portion of the emitter, which generates and defines the focal spot, and to consequently produce a desired temperature distribution across the filament. The number, size and location of the current-crowding slots (notches) in the serpentine-pattemed configuration can be varied to counteract any thermal losses to leads, and attain a desired temperature profile across the emitter.

Figure 4:
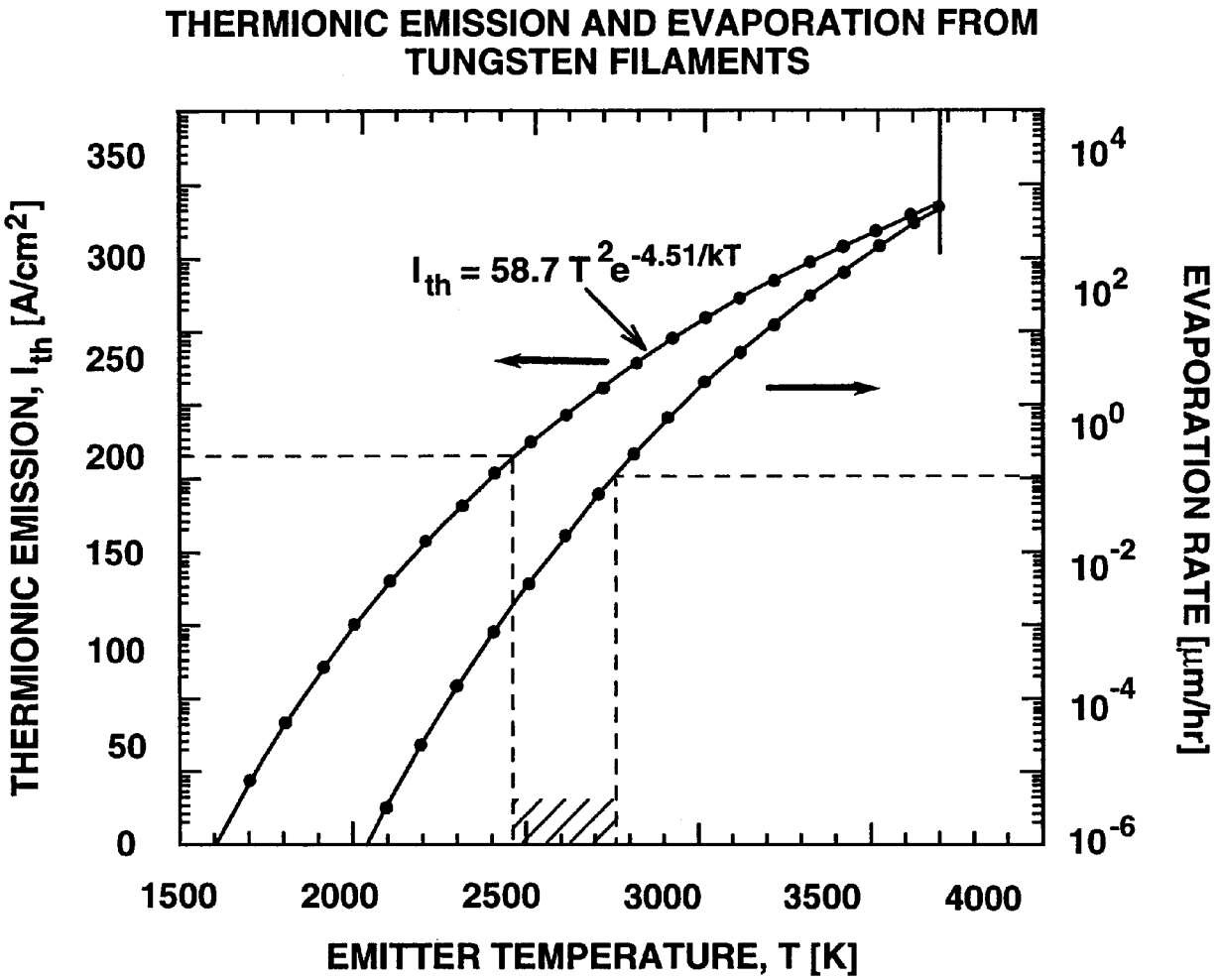
FIG. 4 is a graph illustrating thermionic emission and evaporation rates from tungsten filaments with respect to temperature.

The serpentine-pattemed emitter configuration in FIG. 3 is defined by alternating slots, including first slots 203 extending from one side 75 of the filament 200 and second slots 204 extending from the opposite side 76 of the filament 200. The slots 203 and 204 define respective emitter portions 205 therebetween. In FIG. 4, five (5) emitter segments 207 are illustrated, and this number is merely exemplary of the invention. Any number of emitter segments 207 to achieve the desired emitter temperature distribution is within the scope of the invention.

Performance and reliability of a filament are enhanced by balancing thermionic emission from the filament and evaporation rates of the filament. FIG. 4 illustrates a graph of thermionic emission and evaporation rates from tungsten filaments with respect to emitter temperature. The graph indicates a possible operating temperature regime for filaments. As is illustrated by the graph, temperatures falling to either side of the operating regime will result in either insufficient emission or inadequate life.

Figure 5:
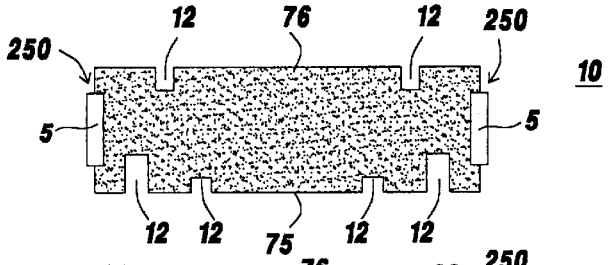
FIG. 5 is a schematic illustration of a single-emitter filament comprising current-crowding slots.
Figure 6:
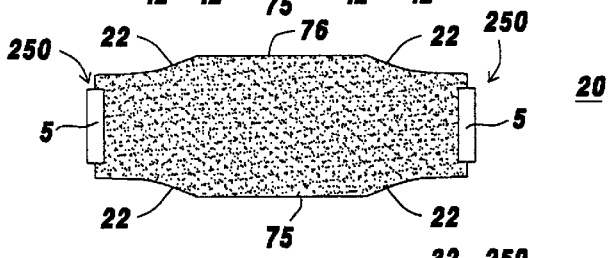
FIG. 6 is a schematic illustration of a single-emitter filament comprising tapered ends.
Figure 7:
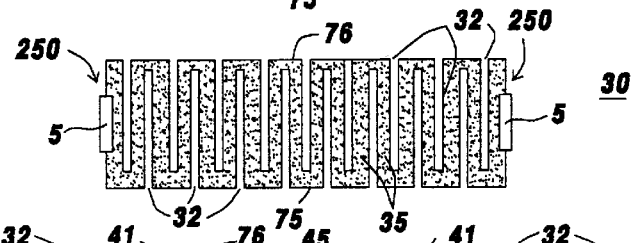
FIG. 7 is a schematic illustration of a single-emitter filament comprising a serpentine-slot pattern.
Figure 8:
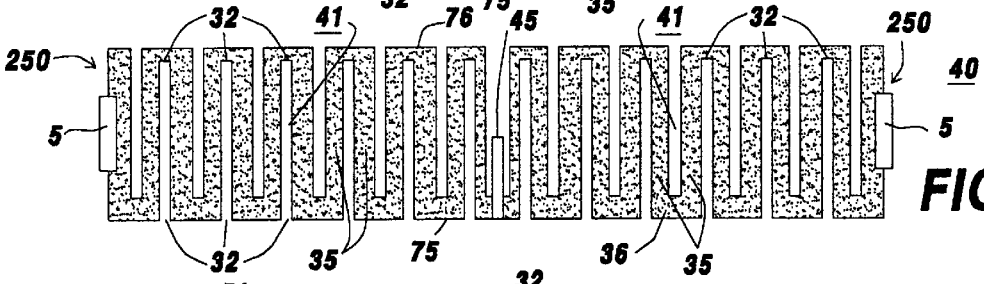
FIG. 8 is a schematic illustration of a first multi-emitter filament comprising a serpentine-slot pattern.
Figure 9:
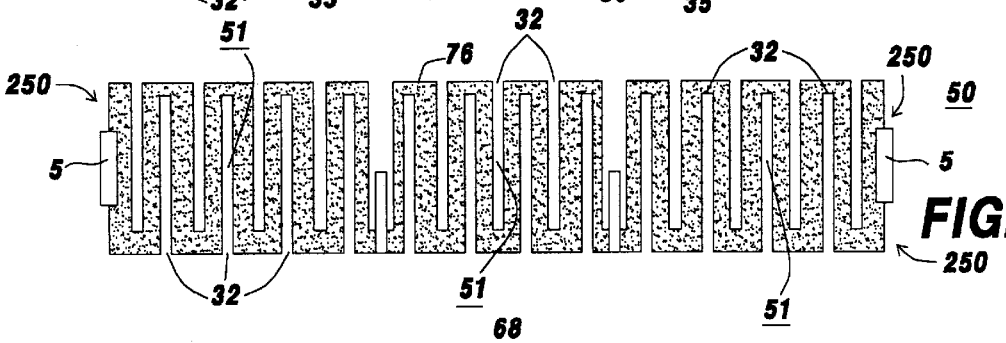
FIG. 9 is a schematic illustration of a second multi-emitter filament comprising a serpentine-slot pattern.
Figure 10:
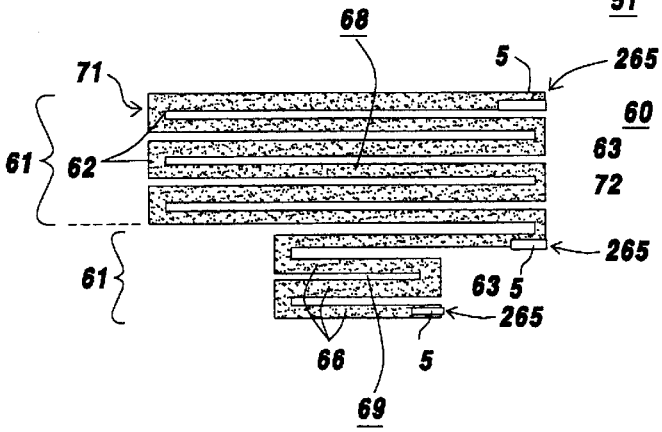
FIG. 10 is a schematic illustration of a third multi-emitter filament comprising a serpentine-slot pattern.

FIGS. 5–10 illustrate some exemplary filament configurations. The filament tabs 250 are connected to leads 5, shown generally and described in detail hereinafter. FIGS. 5–7 illustrate single-emitter filament constructions and FIGS. 8–10 illustrate multi-emitter filaments. FIGS. 8 and 9 comprise a plurality of emitters arranged end-to-end. FIG. 10 illustrates a filament that comprises emitters arranged side-by-side. In the following description, the axes are defined by the coordinate system of FIG. 1. The slots and sides, and the resultant emitter configuration, are as described with respect to FIG. 3, unless otherwise specified.

FIG. 5 illustrates a filament 10, which comprises current-crowding slots 12. The slots 12 comprise differing sizes and shapes interspersed along the filament 10. The slots 12 may be spaced from each other, and have any pattern, depth and width in the filament 10, as needed to attain desired emitter performance.

FIG. 6 illustrates a second filament 20 that comprises tapered ends 21 adjacent the tabs for condensing current. Each tapered section 22 narrows from a constant width at the mid-portion 23 to the tabs 250. The shape of the section 22 can vary depending on the intended performance specifications of the filament. For example, the size and orientation of the tapered section 22 can be varied to counteract heat losses and provide the desired temperature distribution such as uniform temperature distributions across the emitter.

FIGS. 7–10 illustrate serpentine-pattemed emitter configurations formed using alternating slots. The slots serve to control the filament temperature by modifying the current density distribution, and can be interspersed on the filament, for example, with a higher concentration at the ends of the filament to counteract thermal losses to the attachments or any desired function. The slots extend a distance across the filament along the x-axis (FIG. 10), or the y-axis (FIGS. 7–9). In FIGS. 7–9, the alternating slots comprise first slots 32 on one side 75 of the filament and second slots 33 on the opposite side 76 to define a serpentine-pattemed emitter configuration. The slots 32 and 33 define emitter portions 35 therebetween. The exact number of slots is not essential to the concept of the filament and emitter; however, there should be a sufficient number of slots to attain the desired emitter temperature distribution at a permissible level of filament operating current.

FIG. 7 illustrates a third filament 30, that comprises a serpentine-patterned emitter configuration. The filament 30 comprises a single emitter. FIG. 8 illustrates a dual-emitter filament 40, which comprises a plurality (here two) of emitters 41. Although FIG. 8 illustrates two emitters 41, the filament 40 can be attached to a support structure to define three possible emitting structures. For example, the filament 40 defines a first emitter when passing current through a support structure at the two right-most tabs, another emitter when passing current through a support structure at the two left-most tabs and a third emitter when passing current through a support structure at the two outer-most tabs 250.

The dual-emitter filament 50 of FIG. 9 comprises a plurality of emitters 51. Although FIG. 9 illustrates three emitters 51, the number of possible emitter constructions is 6. In FIG. 9, possible emitting structures include passing current through the filament at the two outer tabs, the two shared inner tabs, the two left-most (as illustrated) tabs, the two right-most (as illustrated) tabs, and between each side tab, and the furthermost tab when skipping one shared tab.

FIG. 10 illustrates a side-by-side multi-emitter filament 60 comprising a plurality of emitters 61. The emitters 61 comprise a larger emitter 68 and a smaller emitter 69. The filament 60 comprises tabs 265, where at least one of the tabs 265 is shared by adjoining emitters. The filament 60 also comprises slots 62 extending from one side 71 of the filament 60 and slots 63 extending from the opposite side 72 of the filament 60.

For relatively simple geometries, for example those illustrated in FIG. 6, an elevated-temperature foil punching process can be used to manufacture the filaments. More intricate filaments, for example those having serpentine-pattemed emitter configurations, can be fabricated using one of a number of advanced manufacturing techniques. These techniques include fine-wire electro-discharge machining (EDM) (wire diameter as small as about 0.025 mm), photolithographic masking followed by etching, laser machining, and net-shape vapor deposition.

For filaments made of tungsten, which is a filament material within the scope of the invention, a desired microstructure comprises elongated grains with interlocking grain boundaries to enhance creep resistance. Enhanced creep resistance is important to retain filament stability throughout its lifetime. The microstructure of the filaments is determined by doping, by alloying, as well as by thenno-mechanical processing parameters, such as but not limited to rolling temperatures, area reductions, annealing treatments, and recrystallization treatments. A range of heating methods can be used to affect the recrystallization treatments, including furnace and self-resistance heating of the filament. Failure to select appropriate thermo-mechanical processing and recrystallization treatments can result in filaments having at least one of inadequate dimensional stability, low creep resistance, splits and cracks.

A filament's dimensions (thickness, length and width), when combined with the electron-focusing characteristics of a cathode cup, define the focal spot dimensions. Attainment of the desired focal spot is achieved by an appropriate filament construction and shape, for example a curved emitter. FIGS. 11–15 illustrate possible and exemplary curved emitter configurations, as well as methods and systems to produce a curved emitter. The curved emitter, discussed with respect to FIGS. 11–15, comprises any emitter described above and within the scope of the invention. The radii of curvature R of an emitter are dependent upon several factors, such as cathode-to-anode distance, anode size, and desired focal spot size and shape.

Figure 11:
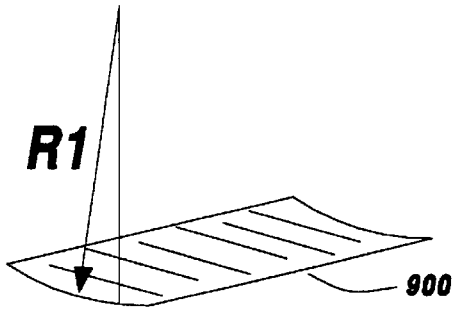
FIG. 11 is a schematic illustration of a curved filament having a radius of curvature in the yz plane.
Figure 12:
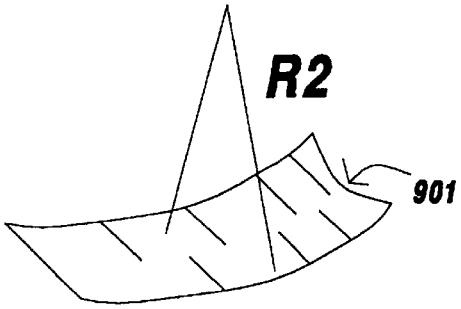
FIG. 12 is a schematic illustration of a second curved emitter having a radius of curvature in the xz plane.
Figure 13:
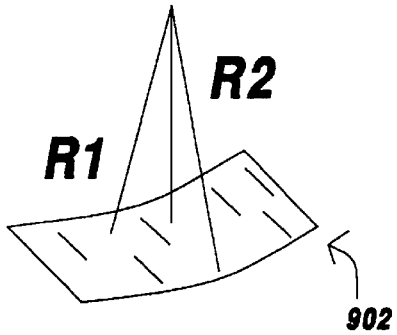
FIG. 13 is a schematic illustration of a third curved emitter having radii of curvature in the yz and xz planes.

FIG. 11 illustrates an emitter 900 with a radius of curvature in the yz plane, R1. Alternatively, emitter 901 (FIG. 12) may have a radius of curvature R2 in the xz plane. Further, an alternative emitter 903 (FIG. 13) may have radii of curvature R1 and R2 along both principal planes, yz and xz. A typical radius of curvature of a curved emitter comprises a radius in a range between about 1.0 mm to infinity.

Figure 14:
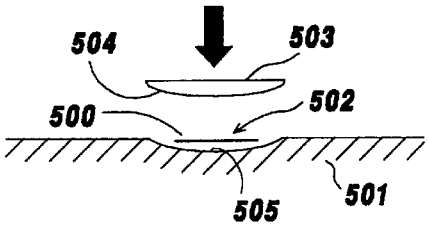
FIG. 14 is a schematic illustration of a system for fabricating curved emitters.

The emitter curvature can be imparted by a hot-die forming process using mating dies as illustrated in FIG. 14. A rigid stationary die 501 comprises a shaped depression, such as a cylindrical, hemispherical or other shaped depression 502, that will result in the desired final filament shape. A nominally flat filament 500 is positioned at the depression 502. Depending on the desired final shape, the filament can extend out of the depression 502, on either or both sides. The system comprises a rigid upper die 503 with a bottom surface 504 that possesses a complementary and mating shape to a surface 505 of the depression 502. The die 503 is operatively connected with an appropriate motive source to move the die 503 to and away from the depression 502, for example in a reciprocating manner. In the system of FIG. 14, as well as the system of FIG. 15, at least one of the dies may be pre-heated to facilitate the forming process.

The operation of the system for producing a curved emitter of FIG. 14 will now be discussed. A flat filament 500 is initially placed in the depression 502, and the die 503 is moved toward the filament 500. The interaction of the die 503 with the depression 502 forces the filament 500 into a desired curved shape conforming to die surfaces. The curved emitter is formed and the movable mating die 503 is then retracted.

Figure 15:
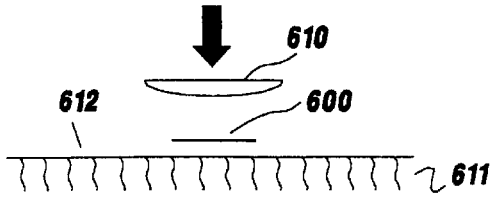
FIG. 15 is a schematic illustration of a second system for fabricating curved emitters.

Another system for producing curved emitters comprises a movable rigid die 610 and a compliant mold 611, as illustrated in FIG. 15. The compliant mold 611 comprises a nominally flat surface 612 and is formed of an appropriate material that deforms when subjected to pressure, but recovers its initial shape when the pressure is released. For example, the compliant mold 611 can comprise a high-temperature silicone rubber material.

In operation, a nominally flat emitter 600 is initially placed on the compliant mold 611. Next, the die 610 is moved toward the filament 600, forcing the emitter 600 to conform to the die surface 612 when compressed against the compliant mold 611. A curved emitter 600 is thus formed upon retraction of the die 610. Again, the dies may be preheated to facilitate deformation of the emitter material.

Another aspect of the invention is a stable support system that mechanically and electrically attaches a filament to an associated support element. The attachment system provides improved performance over known structures. FIGS. 16–24 illustrate attachment systems, as embodied by the invention; however the representation of the filament is merely exemplary. Any filament within the scope of the invention can be utilized. Attributes of the attachment system are as follows: it minimizes constraints on the filament to the extent that distortion of the filament surface does not occur during or after annealing; it allows for thermal expansion of the filament during operation without distortion of the filament emitting surface; it extends emitter life; it has sufficiently low thermal mass to prevent non-uniform temperatures due to excessive heat losses from the filament and consequent reduction in emission current density; and it provides adequate mechanical constraint to retain the filament in proper position and in adequate electrical contact during prolonged operation, including extensive thermal cycling.

In the following descriptions, leads are first attached to attachment posts and thereafter the emitter is attached to the leads. These steps avoid problems inherent to attachments of known filaments comprising integral leads.

Figure 16:
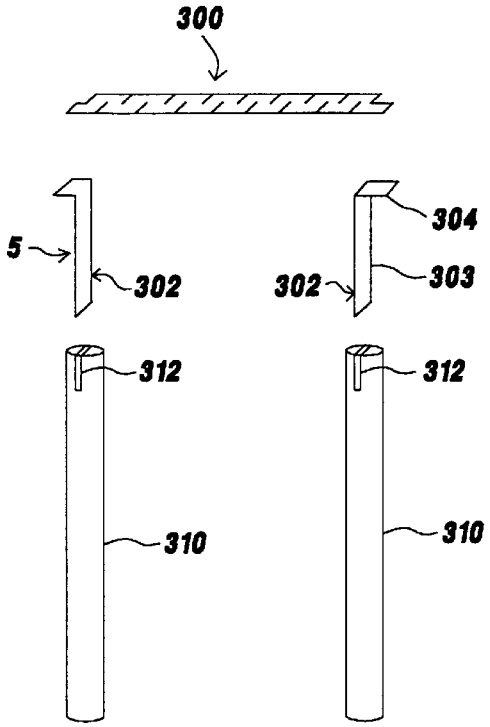
FIGS. 16 and 17 are schematic illustrations of a first attachment system.
Figure 17:
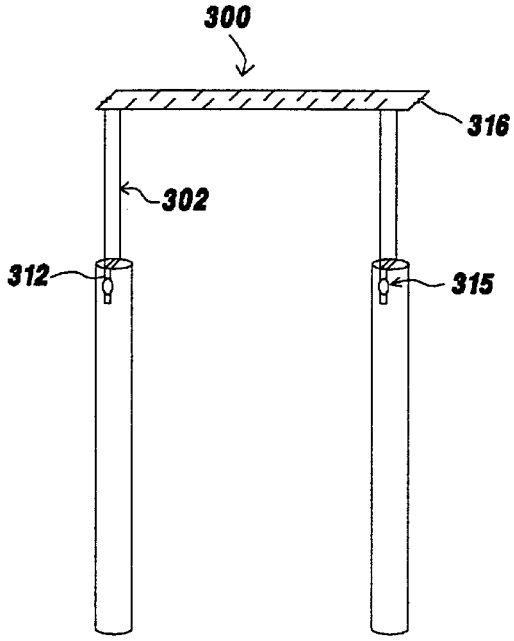

In FIGS. 16 and 17, a filament 300 is attached to leads 5 (generally illustrated in the above figures) that comprise pre-bent thin-foil leads 302 (hereafter leads) attached to the filament tabs 465. The leads 302 are attached by any appropriate attachment method, such as but not limited to, at least one of laser-welding, electron-beam welding, resistive welding, brazing, and combinations thereof. The leads 302 comprise a structure that elastically deflects under the thermal expansion and contraction of the filament 300 and carries filament current without excessive self-heating. The material of the leads 302 includes, but is not limited to, refractory metal materials such as at least one of tungsten, tantalum, molybdenum, rhenium, niobium, and alloys thereof. The leads are thin, for example having a thickness in the range between about 0.01 mm to about 1.0 mm.

The leads 302, as illustrated in FIGS. 16 and 17, further comprise a long-leg lead portion 303 and a short-leg portion 304. The long-leg lead portions 303 connect to attachment posts 310 that comprise part of the support system of a cathode (not illustrated). The attachment posts 310 comprise pre-machined slots 312, and are formed from an appropriate material, including but not limited to at least one of molybdenum, niobium and alloys thereof. The long-leg lead portion 303 mates with the premachined slots 312. The slots 312 comprise an opening having a thickness essentially equal to the thickness of the leads 302.

The attachments of the bent leads 302 to the attachment posts 310 may be further secured, for example by an appropriate weld, including at least one of laser-beam welding and electron-beam welding and resistive welding, with or without braze 315. Further, the attachment of the lead 302 to filament tab 265 can be secured by an appropriate weld, as discussed above.

Figure 18:
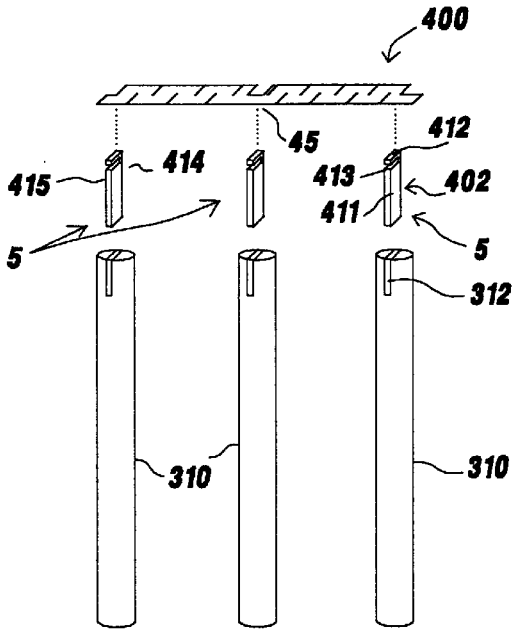
FIGS. 18 and 19 are schematic illustrations of a second attachment system.
Figure 19:
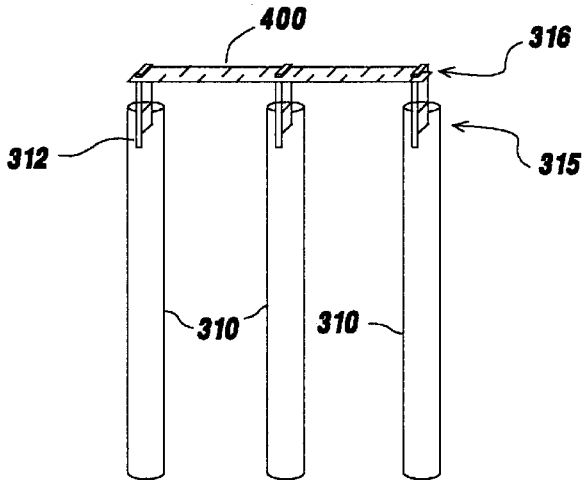

FIGS. 18 and 19 illustrate a second attachment system, as embodied by the invention. The filament 400 is illustrative to the filaments illustrated above. The filament 400 comprises three tabs 465. The filament 400 is attached to thin-foil leads 402 (hereafter leads) at each tab. Each lead 402 comprises a foil material, and is formed with an elongated portion 411, a second portion 412, and an open-ended slot 413 that serves as the receptacle for the tab 465. The open-ended slot 413 is open at one side 415 of the lead 402.

The filament 400 is attached to the lead 402 by sliding the tab 465 into the open-ended slot 413. The engagement therebetween is preferably a small-tolerance fit. The tab 465 may be additionally secured to the lead 402 by at least one of the above described methods for securing the bent leads 302 to the filament 300. The leads 402 can be further secured to attachment posts 310 in a manner similar, to that discussed above.

Figure 20:
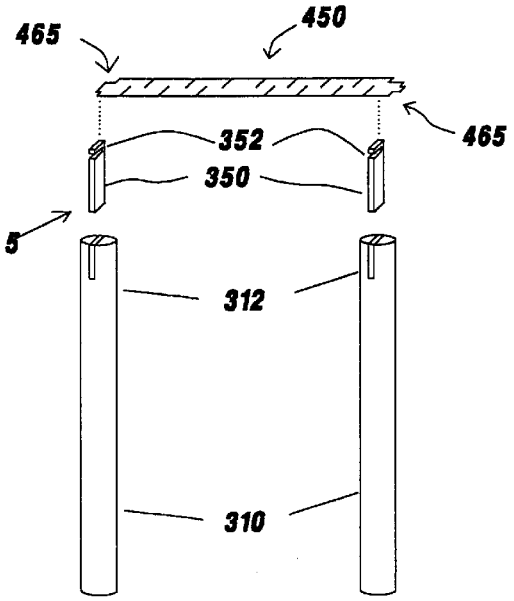
FIGS. 20 and 21 are schematic illustrations of a third attachment system.
Figure 21:
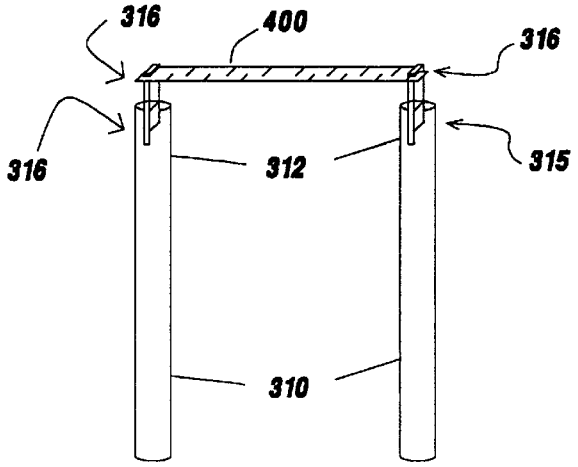

FIGS. 20 and 21 illustrate a third attachment system. The filament 450 comprises a serpentine-pattemed emitter with tabs 465. The tabs 465 extend from the ends of the filament 450. Each tab is attached to foil leads 350 (hereafter leads). Each lead comprises a foil material with a closed-sided slot 352 that serves as the tab receptacle. The tabs 465 and the slot 352 are approximately complementary in size, so that the tab 465 fits snugly into the slot 352. The posts 310 and other details of the system are set forth above.

Figure 24:
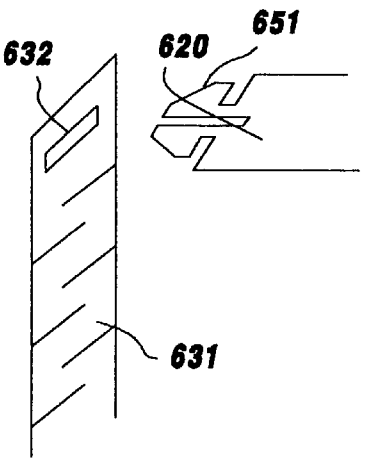
FIGS. 22–24 are schematic illustrations of a fourth attachment system.
Figure 23:
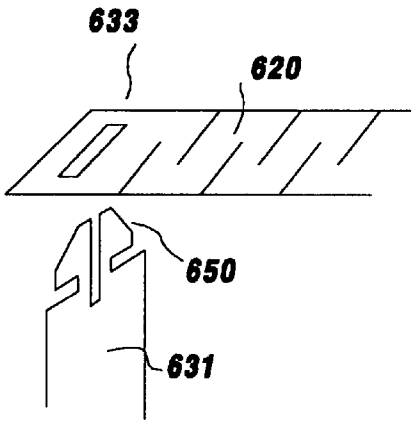
Figure 22:
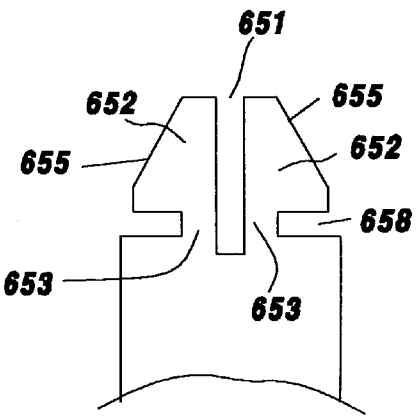

FIGS. 22–24 illustrate a fourth attachment system. The fourth attachment system relies upon a locking nib structure 650 on one of the lead and filament to secure the filament and lead together. This system comprises a locking nib structure on the lead and a slot on the tab. Alternatively, this system comprises a locking nib structure on the tab and a slotted lead. The interaction, attachment order, and steps to assemble the lead, post and emitter are explained above. The locking nib structure 650, whether provided on the filament or lead, comprises two protrusions 652 that are substantial mirror images of each other. The protrusions 652 are separated from each other by a nib slot 651 and are connected to the base structure (tab or lead) by attachment ends 653 to define a locking groove 658. The projections terminate in a slanted side wall 655 that defines a cam surface.

In use, the locking nib structure 650 cooperates with a slot 632, which is located in one of a lead 631 and a tab 620. The locking nib structure 650 is inserted into the slot 632, until the side walls 655 contact edges of the slot 632. The protrusions 652 are then compressed about the attachment ends 653 by the sides of the slot 632 and deflection of the protrusions 652 is accommodated by the nib slot 651. This movement continues until the entire protrusions 652 have passed through the slot 632 and the locking nib structure 650 returns to a relaxed state. At this point, the slot 632 is securely positioned in a locking groove 658 at nib the base of the locking nib structure 650. The filament 620 and leads 631 are thus connected. As above, welds may be used to further secure the connections if desired; however welds are not needed as the locking nib structure provides a suitable electrical and mechanical connection.

Filaments, emitters, support structures and methods, as embodied by the invention, have applications in X-ray tubes cathodes. A further application of the invention comprises illumination for such use as projection lamps, where a uniform luminosity is desired.

While the embodiments described herein have been discussed, it will be appreciated from the specification that various combinations of elements, variations or improvements therein may be made by those skilled in the art, and are within the scope of the invention.

What is claimed is:

1. A support system for a filament, wherein the filament comprises at least one emitter and a plurality of connection tabs; the support system comprising:

a plurality of foil leads attachable to the plurality of tabs of said emitter; and a support structure comprising at least a plurality of attachment posts, each post comprising a slot adapted to receive a lead, wherein each lead connects to a slot of the plurality of attachment posts and then each tab is attached to a lead.

2. A system according to claim 1, wherein at least one lead comprises a pre-bent lead.

3. A system according to claim 1, further comprising additional attachment for connecting said lead to a post and a tab to a lead, the additional attachment selected from the group consisting of:

laser-welding, electron-beam welding, resistive welding, and brazing.

4. A system according to claim 1, wherein the plurality of leads comprises a material selected from the group consisting of:

tungsten, tantalum, molybdenum, niobium, rhenium and alloys thereof.

5. A system according to claim 1, wherein said emitter comprises a plurality of current-crowding structure slots and at least two tabs, each lead comprising at least one open-ended slot cooperating with the tab, wherein said emitter is supported by fitting said open-ended slot with the tab.

6. A system according to claim 1, wherein said emitter comprises a plurality of current-crowding structure and at least tabs, each lead comprising at least one closed sided slot cooperating with the tab, wherein said emitter is supported by a fitting tab into a closed-sided slot.

7. A system according to claim 1, wherein one of the tab and the lead comprises a locking nib structure and the other of the tab and the lead comprises a closed-sided slot that receives the locking nib structure.

8. A system according to claim 1, wherein said emitter comprises a thickness in a range between about 0.01 mm to about 1.0 mm.

9. A method for determining a geometry of a filament, the method comprising;

generating a 3-D mesh of a filament geometry;

solving a coupled thermal-electrical equations to determine a temperature distribution across a surface of a filament geometry subject to imposed boundary conditions; and iterating the filament geometry and solving for temperature distributions subject to the imposed boundary conditions until the filament geometry conforms with temperature specifications.

10. A method according to claim 9, wherein the imposing boundary conditions comprise imposing at least one of heating current, ambient temperature, and lead temperature boundary conditions.

11. A method according to claim 9, wherein the solving for a temperature distribution further comprises accounting for at least one of Joule heating, emissive radiation, and thermal conduction.

12. A method according to claim 9, wherein the method determines a filament geometry for a single emitter filament or a mufti-emitter filament, where the filament comprises a metal foil, a metal ribbon or a metal sheet, each filament comprises a thickness in a range between about 0.01 mm to about 1.0 mm.

* * * * *